US005573434A

United States Patent [19]

Ittah et al.

[11] Patent Number: 5,573,434

[45] Date of Patent: Nov. 12, 1996

[54] FEMALE ELECTRICAL CONTACT MEMBER

[75] Inventors: Jean Ittah, Villeneuve La Garenne; Olivier Plessis, Chaville, both of France

[73] Assignee: Connecteurs Cinch, Montigny Le Bretonneux, France

[21] Appl. No.: 397,878

[22] Filed: Mar. 2, 1995

[30] Foreign Application Priority Data

Mar. 21, 1994 [FR] France ..... 94 03281

[51] Int. Cl.[6] ..... H01R 13/18

[52] U.S. Cl. ..... 439/839

[58] Field of Search ..... 439/839, 847, 439/851, 845, 849, 850, 843, 844, 846

[56] References Cited

U.S. PATENT DOCUMENTS 5,094,636 3/1992 Zinn et al. ..... 439/839
5,338,229 8/1994 Egenolf ..... 439/839
5,360,356 11/1994 May et al. ..... 439/839

FOREIGN PATENT DOCUMENTS 0433610 6/1991 European Pat. Off. .
0583590 2/1994 European Pat. Off. .
3941773 6/1991 Germany .

*Primary Examiner*—Gary E. Paumen
*Attorney, Agent, or Firm*—Greenblum & Bernstein, P.L.C.

[57] ABSTRACT

Female electrical contact member is made from a metal blank cut out and bent to shape so that it has at one end electrical conductor fixing elements and at the other end a rectangular section passage having a bottom wall, a top wall and two side walls from which are cut out elastic bars bent towards the interior of the passage to constitute a clamp adapted to grip a male tongue inserted through an insertion opening of the passage. The free ends of the bars face towards the insertion opening. The elastic action of the bars is strengthened by bracing bars of an attached, initially separate member cooperating with the elastic bars. The attached member comprises two plates fixed against the side walls and from which the bracing bars are cut out.

20 Claims, 5 Drawing Sheets

FEMALE ELECTRICAL CONTACT MEMBER

BACKGROUND OF THE INVENTION

1. Field of the invention

The present invention concerns a female electrical contact member.

2. Description of the prior art

The invention relates to members having electrical conductor fixing means at one end and a rectangular section passage at the other end adapted to receive a male tongue, elastic bars cut out from two opposite walls of the passage being bent towards the interior of the passage to form an elastic clamp adapted to grip the male tongue.

As the material from which the female member is made must be a good electrical conductor and as the elasticity of the material is low a separate member is provided to enhance the elasticity of the clamp, made from a material such as spring steel and including bracing bars which, bearing against said bars, enhance their elastic action.

These separate members are often complex and increase the unit cost of these female members.

An object of the invention is to remedy these drawbacks.

SUMMARY OF THE INVENTION

The invention consists in a female electrical contact member made from a metal blank cut out and bent to shape so that it has at one end electrical conductor fixing means and at the other end a rectangular section passage having a bottom wall, a top wall and two side walls from which are cut out elastic bars bent towards the interior of the passage to constitute a clamp adapted to grip a male tongue inserted through an insertion opening of the passage, the free ends of the bars facing towards the insertion opening, the elastic action of the bars being strengthened by bracing bars of an attached, initially separate member cooperating with the elastic bars, wherein the attached member comprises two plates fixed against the side walls and from which the bracing bars are cut out.

In accordance with one constructive feature of the invention, each side wall includes a cut-out lug bent so that it extends towards the free end of the elastic bar cut out from the corresponding wall. This provides a guide for the male tongue at the insertion opening and acts as a safety feature preventing the insertion of a male tongue that is too thick.

In accordance with a further feature of the invention, each plate has an abutment bent so that it extends towards the passage and adapted to limit movement of the elastic bars.

In accordance with a specific constructive feature of the invention, each side wall is shaped to form rivets adapted to be inserted into holes in the plates.

Each plate can have a retaining lug at the end facing towards the electrical conductor fixing means.

In one embodiment of the invention the top wall of the passage is formed by an extension of one side wall and extends as far as the free edge of the other side wall, forming a slot, the top wall includes openings, and the plate, adapted to be fixed to the other side wall, has a lip adapted to be inserted in the slot and terminating at lugs adapted to engage in the openings.

There is therefore no risk of the resulting electrical contact member being deformed on insertion of the male tongue.

Finally, at their free ends, which in use face towards the insertion opening of the passage, the plates have tongues adapted to be bent towards the interior of the passage.

The invention will now be described in more detail with reference to specific embodiments shown by way of example only in the appended drawings.

DETAILED DESCRIPTION OF THE PREFERRED EMBODIMENTS

Figure 1:
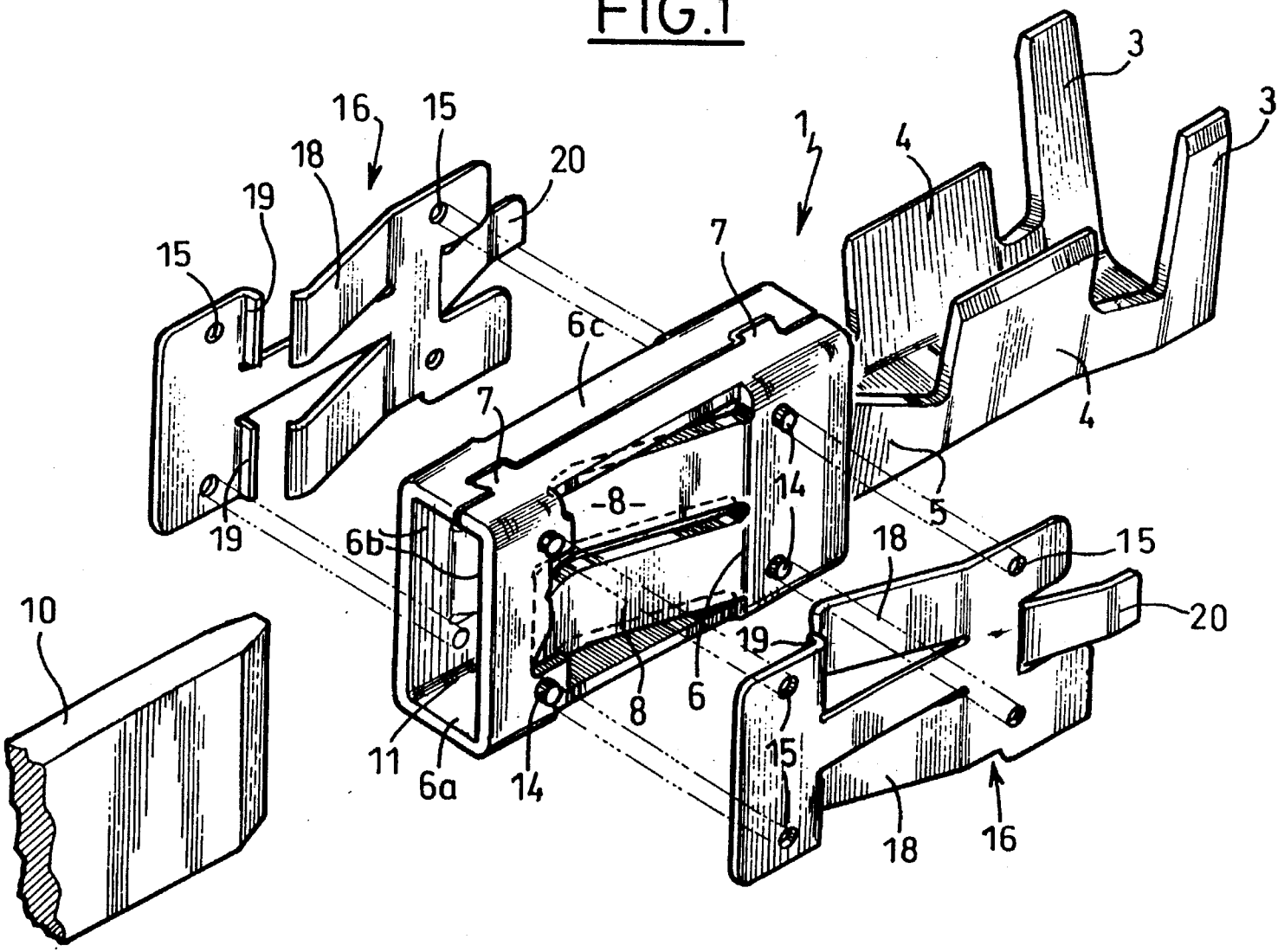
FIG. 1 is an exploded perspective view of a female electrical contact member of the invention.
Figure 2:
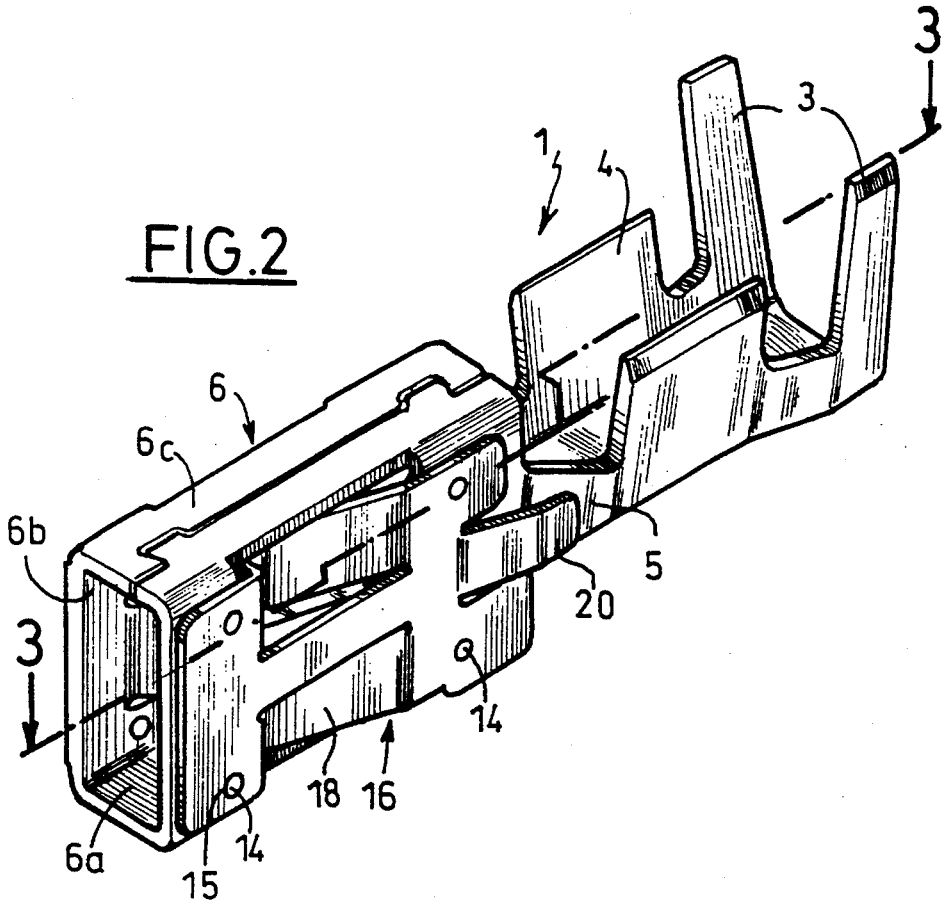
FIG. 2 shows the female electrical contact member in perspective.
Figure 3:
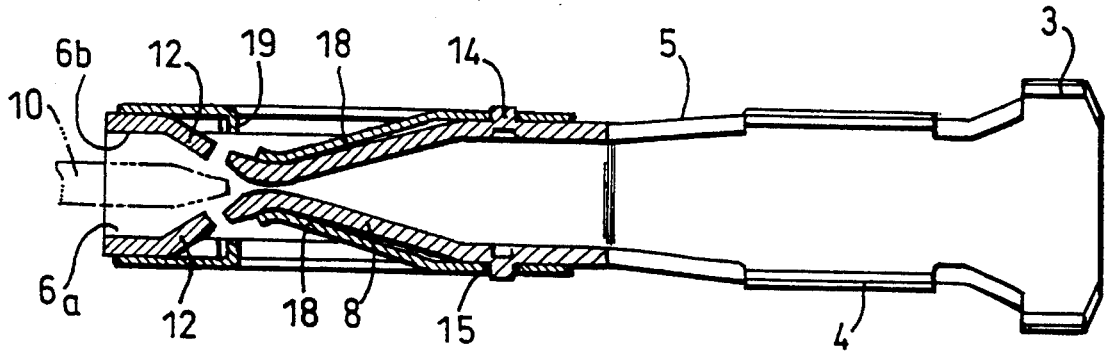
FIG. 3 is a view in section on the line 3—3 in FIG. 2.
Figure 4:
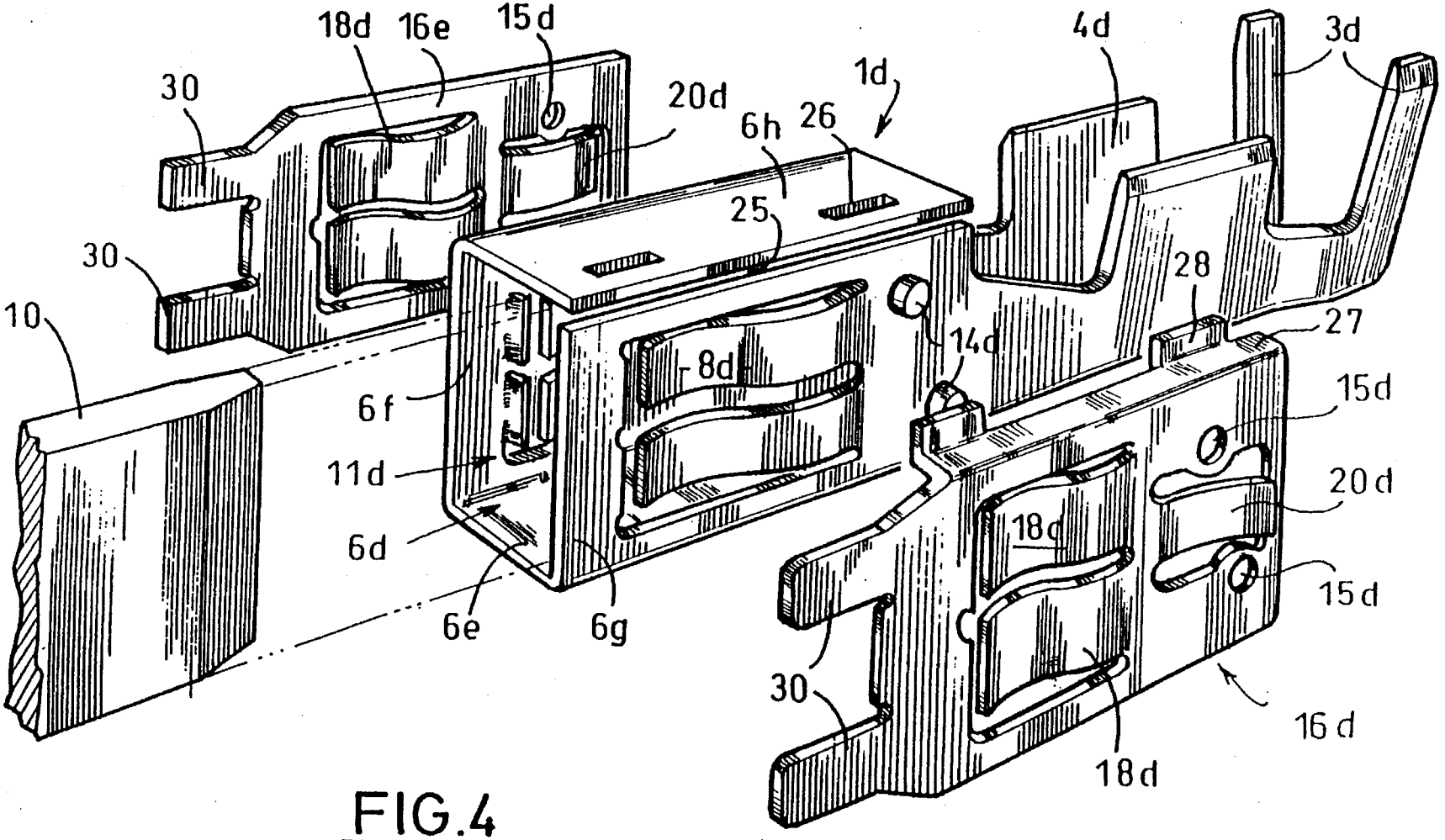
FIG. 4 is an exploded perspective view of an alternative embodiment of the invention.
Figure 5:
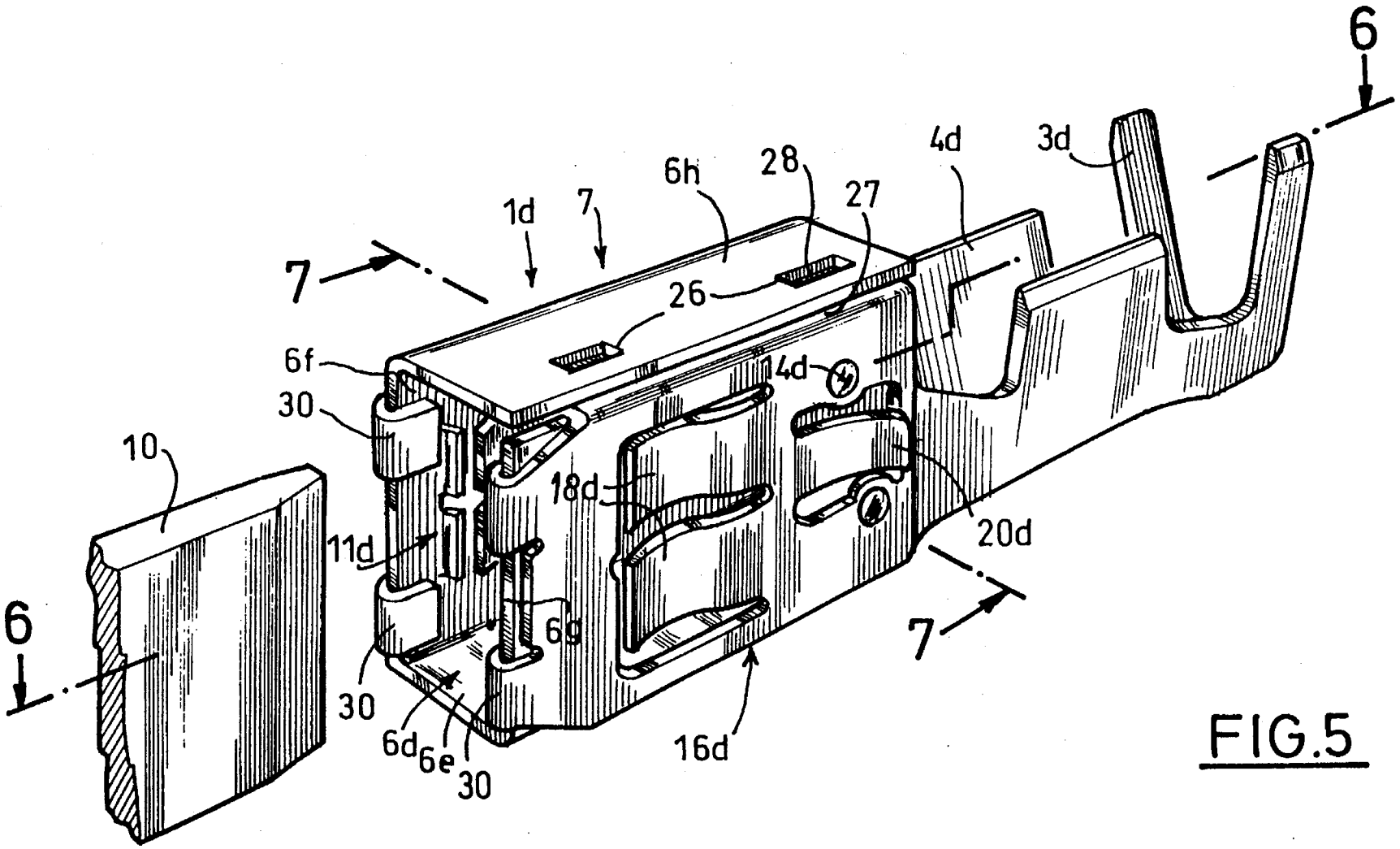
FIG. 5 is a perspective view of the electrical contact member in this alternative embodiment.
Figure 6:
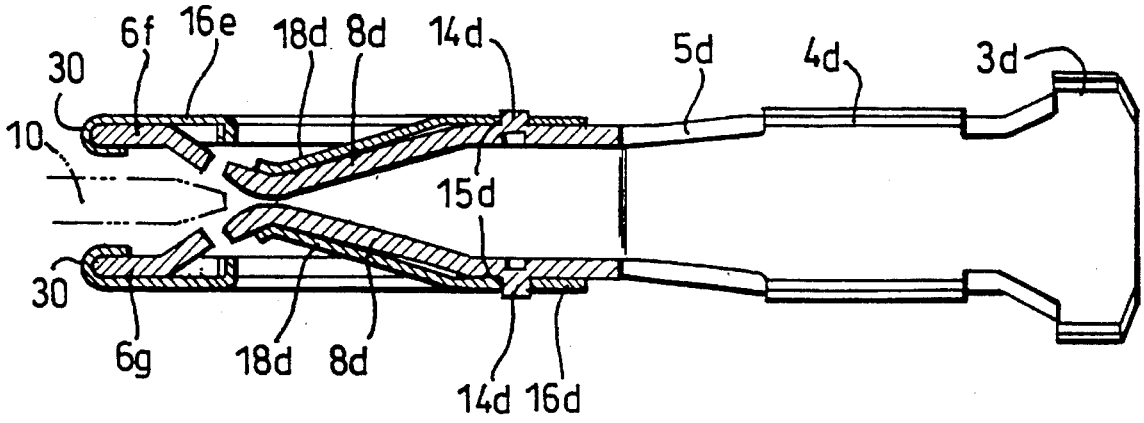
FIG. 6 is a view in section on the line 6—6 in FIG. 5.
Figure 7:
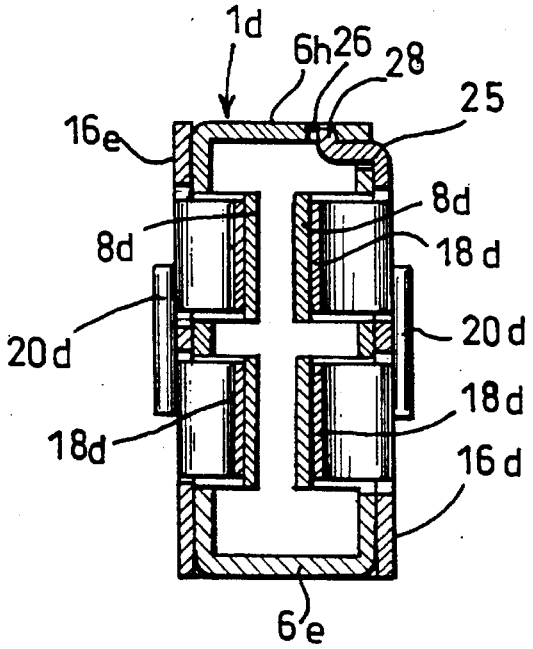
FIG. 7 is a view in section on the line 7—7 in FIG. 5.

The electrical contact member shown in FIGS. 1 to 3 includes a main body 1 made from a metal which is a good electrical conductor and has some elasticity. The body 1 is made from a cut-out blank which is bent to shape so that it has at one end lugs 3 adapted to be crimped onto an insulated electrical conductor and lugs 4 adapted to be crimped onto a bared end of the conductor.

At the end opposite the lugs 3 the body 1 is extended by a channel-section part 5 from the end of which opposite that adjacent the lugs 4 extends a rectangular section part 6 forming a passage adapted to receive a male tongue 10 through an insertion end 11.

The passage 6 has a bottom wall **6*a*, two side walls 6*b* and a top wall 6*c* formed by the ends of a strip cut out from the metal blank assembled together by dovetails 7**.

Two elastic bars 8 are cut out from the side walls **6*b* and bent so that they extend inside the passage 6 and form elastic clamps adapted to grip the male tongue 10: the bars 8 are cut out in such a way that their free ends face towards the insertion end 11. The said free ends are curved so that the convex side of a bar of one wall 6*b* faces the convex side of a corresponding bar of the other wall 6*b***.

A lug 12 cut out from each side wall **6*b* is bent towards the interior of the passage so that it extends towards the free end of the corresponding elastic bar 8. These lugs 12 guide the male tongue towards the clamps formed by the bars 8**.

Four rivets 14 are formed in the side walls **6*b* and are adapted to be inserted into holes 15 in a plate 16**, the free end of the rivets being peened over to attach the plates.

Each plate 16 is made from a metal with good mechanical properties, such as spring steel.

Each plate 16 is cut out to a shape having two elastic bracing bars 18 adapted to bear against the lateral surface of the bars 8 in order to strengthen the elastic action of the clamps.

Abutments 19 are formed in the plates 16 at the free end of the bracing bars 18. They extend into openings in the wall **6*b* to limit movement of said bars 8**.

At the end opposite the bracing bars 18, each plate 16 has a cut-out retaining lug 20 to facilitate fixing of the member into an electrical connector housing member.

In the embodiment shown the plates 16 are attached by rivets, but other attachment means could be used.

FIGS. 4 through 7 show an alternative embodiment which will not be described in detail and use the same reference numbers as the previous figures to denote corresponding parts of this embodiment, with the suffix "d" added.

The main body 1*d* has a passage 6*d* with a bottom wall 6*e*, two side walls 6*f* and 6*g* and a top wall 6*h* which is formed by an extension of the wall 6*f* and which extends as far as the free end of the wall 6*g*.

There is a slot 25 between the free end of the wall 6*g* and the top wall 6*h*. There are two openings 26 in the top wall 6.

The side wall 6*f* is adapted to receive a plate 16*e* and the side wall 6*g* is adapted to receive a plate 16*d*.

The plate 16*d* has a rim 27 adapted to be inserted into the slot 25 with two lugs 28 adapted to be engaged in the openings 26.

The plate 16*d* is fixed by rivets 14*d* inserted into holes 15*d* and by tongues 30 which are bent towards the interior of the passage 6*d*.

The plate 16*e* is fixed against the side wall 6*f* by rivets 14*d* inserted in the holes 15*d* and by the tongues 30 bent against the inside of the wall 6*f*.

This arrangement has the advantage of providing an electrical contact member in which their is no risk of deformation of the passage 6*d* on insertion of the male tongue 10 via the opening 11*d*.

Of course, the invention is not limited to the embodiment that has just been described and shown. Numerous modifications of detail can be made thereto without departing from the scope of the invention.

There is claimed:

1. Female electrical contact member, comprising:

a metal blank cut out and bent to shape so as to comprise a first end and a second end;

electrical conductor fixing elements at said first end;

a rectangular section passage at said second end, said rectangular section passage defining an interior and an insertion opening, and comprising a bottom wall, a top wall, and two side walls;

elastic bars cut out from said two side walls and bent towards the interior of said rectangular section passage to form a clamp capable of gripping a male tongue when inserted through the insertion opening; and an attached, initially separate, member comprising bracing bars cooperating with and strengthening said elastic bars, said attached member comprising two plates fixed against said side walls and from which said bracing bars are cut out.

2. The female electrical contact member according to claim 1, wherein said elastic bars comprise free ends facing towards said insertion opening.

3. The female electrical contact member according to claim 2, wherein each side wall includes a cut out lug bent so that it extends towards said free end of said elastic bar cut out from a corresponding side wall.

4. The female electrical contact member according to claim 3, wherein each of said two plates includes an abutment bent to extend towards said interior of said rectangular section passage adapted to limit movement of said elastic bars.

5. The female electrical contact member according to claim 4, wherein each of said two side walls comprises rivets capable of engaging openings in said plate.

6. The female electrical contact member according to claim 1, wherein each of said two plates includes an abutment bent to extend towards said interior of said rectangular section passage adapted to limit movement of said elastic bars.

7. The female electrical contact member according to claim 1, wherein each of said two side walls comprises rivets capable of engaging openings in said plate.

8. The female electrical contact member according to claim 1, wherein each of said two plates includes a retaining lug at an end facing towards said electrical conductor fixing elements.

9. The female electrical contact member according to claim 1, wherein said top wall of said passage is formed by an extension of one of said two side walls and extends as far as a free edge of the other of said two side walls forming a slot, said top wall including openings, and said plate adapted to be fixed to said other side wall comprising a rim adapted to be inserted into said slot and terminating at lugs adapted to be engaged in said openings.

10. The female electrical contact member according to claim 9, wherein said plates include tongues adapted to be bent at their free ends towards the interior of said rectangular section passage, which when attached to said two side walls is towards said insertion opening.

11. Female electrical contact member, comprising:

an elongated metal member comprising a first end and a second end;

electrical conductor fixing elements at said first end;

a rectangular section passage at said second end, said rectangular section passage defining an interior and an insertion opening, and comprising a bottom wall, a top wall, and two side walls;

elastic bars on said two side walls bent towards the interior of said rectangular section passage to form a clamp capable of gripping a male tongue when inserted through the insertion opening; and two plates comprising bracing bars, each of said two plates being fixed against one of said two side walls so that said bracing bars cooperate with and strengthen said elastic bars.

12. The female electrical contact member according to claim 11, wherein said elastic bars comprise free ends facing towards said insertion opening.

13. The female electrical contact member according to claim 12, wherein each side wall includes a lug bent so that said lug extends towards said free end of an elastic bar on a corresponding side wall.

14. The female electrical contact member according to claim 13, wherein each of said two plates includes an abutment extending towards said interior of said rectangular section passage adapted to limit movement of said elastic bars.

15. The female electrical contact member according to claim 14, wherein each of said two side walls comprises rivets capable of engaging openings in said plate.

16. The female electrical contact member according to claim 11, wherein each of said two plates includes an abutment extending towards said interior of said rectangular section passage adapted to limit movement of said elastic bars.

17. The female electrical contact member according to claim 11, wherein each of said two side walls comprises rivets capable of engaging openings in said plate.

18. The female electrical contact member according to claim 11, wherein each of said two plates includes a retaining lug at an end facing towards said electrical conductor fixing elements.

19. The female electrical contact member according to claim 11, wherein said top wall of said passage is formed by an extension of one of said two side walls and extends as far as a free edge of the other of said two side walls forming a slot, said top wall including openings, and said plate adapted to be fixed to said other side wall comprising a rim adapted to be inserted into said slot and terminating at lugs adapted to be engaged in said openings.

20. The female electrical contact member according to claim 19, wherein said plates include tongues adapted to be bent at their free ends towards the interior of said rectangular section passage, which when attached to said two side walls is towards said insertion opening.

* * * * *